United States Patent [19]

Golubkov et al.

[11] 4,395,314

[45] Jul. 26, 1983

[54] PROCESS FOR THE PRODUCING CONCENTRATED SOLUTION OF SODIUM HYDROXIDE AND CHLORINE

[76] Inventors: Sergei V. Golubkov, ulitsa Menzhinskogo, 21, kv. 420; Ernest A. Druzhinin, ulitsa Gvardeiskaya, 4, kv. 32; Vladimir M. Zimin, 8-ya ulitsa Textilschikov, 10, kv. 18; Vladimir L. Kubasov, Kirovogradskaya ulitsa, 4, korpus 2, kv. 135; Florenty I. Lvovich, 1 Nizhne Mikhailovsky proezd, 16, kv. 55; Anatoly F. Mazanko, Stavropolskaya ulitsa, 56, korpus 1, kv. 73, all of Moscow, U.S.S.R.

[21] Appl. No.: 374,205

[22] Filed: May 3, 1982

[30] Foreign Application Priority Data

May 7, 1981 [SU] U.S.S.R. ..... 3291365

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 3,403,083 9/1968 Currey et al. ..... 204/98

*Primary Examiner*—R. L. Andrews

*Attorney, Agent, or Firm*—Ladas & Parry

[57] ABSTRACT

The process according to the present invention relates to the production of a concentrated solution of sodium hydroxide and chlorine which comprises electrochemical decomposition of a concentrated solution of sodium chloride with a concentration of from 4.3 to 5.3 mol/l at a temperature within the range of from 90° to 108° C. with the degree of decomposition of sodium chloride of 0.9 to 1.0 and the rate of flow of the solution of sodium chloride through a filtering diaphragm of from 3 to 5 ml/hr per 1 A of the electrolysis current, followed by removing the electrolysis products from the process.

The process according to the present invention makes it possible to substantially simplify the known procedure of chlorine manufacture, since it ensures obtaining the final commercial product directly in the electrolysis, thus avoiding the stage of evaporation.

2 Claims, No Drawings

PROCESS FOR THE PRODUCING CONCENTRATED SOLUTION OF SODIUM HYDROXIDE AND CHLORINE

FIELD OF THE INVENTION

The present invention relates to a process of electrolysis of a solution of an alkali metal chloride, more specifically sodium chloride, in an electrolyzer with a filtering diaphragm and with a simultaneous production of a concentrated solution of an alkali metal hydroxide, more particularly sodium hydroxide, and chlorine.

BACKGROUND OF THE INVENTION

Known in the art is a process for simultaneously producing a solution of sodium hydroxide and chlorine by way of an electrochemical decomposition of a solution of sodium chloride in an electrolyzer with a filtering diaphragm, while maintaining sodium chloride concentration within the range of from 240 to 310 g/l (4.1 to 5.3 mol/l) and pH values within the range of from 0.2 to 4.5. The process is conducted at a temperature of from 95° to 104° C.

The electrolysis is effected by continuously passing a solution of sodium chloride through the diaphragm in the direction of from the anode to the cathode at a rate of from 10.0 to 13.5 ml/hr per 1 A of the electrolyzer load. The degree of electrochemical decomposition of sodium chloride (the degree of conversion of chloride to sodium hydroxide) is equal to 0.50–0.53.

To maintain a high concentration of sodium chloride in the electrolyzer, use is made of a feeding solution with a concentration of 315–330 g/l (5.4–5.65 mol/l) of NaCl. The feeding solution supply into the electrolyzer is effected with an excess relative to the solution passage through the diaphragm.

The excessive amount of the solution of sodium chloride is passed to the stage of after-saturation with sodium chloride, then recycled back to the electrolyzer.

According to experimental data, the current yield of sodium hydroxide (alkali) is 93.9–97.2% at the following ranges of the process parameters: concentration of the solution of sodium hydroxide of 140–260 g/l (3.5–6.5 mol/l), concentration of sodium chloride in the electrolyzer of from 240 to 300 g/l (4.1 to 5.3 mol/l), value of pH of the anolyte of from 2.1 to 4.05 (cf. U.S. Pat. No. 3,403,083 Cl. 204–98, published Sept. 24, 1968).

A disadvantage of this prior art process resides in the production of a relatively diluted solution of sodium hydroxide with a high content of the residual sodium chloride-up to 200 g/l, high rates of consumption of heating steam for evaporation of the resulting electrolytical liquors for the preparation of a concentrated solution of sodium hydroxide with a content of NaOH of from 600 to 650 g/l (15.0–16.5 mol/l).

Also known in the art is a process for a simultaneous production of a concentrated solution of an alkali metal hydroxide, for example sodium hydroxide, and chlorine by way of an electrochemical decomposition of an alkali metal chloride in an electrolyzer with a filtering diaphragm upon passing the solution of sodium chloride through the filtering diaphragm.

Fed into an electrolyzer is a concentrated solution of sodium chloride containing 290 to 315 g/l (5.0 to 5.4 mol/l) of NaCl. The process is conducted at the temperature of 90° C., pH value below 1.5 (within the range of from 1.0 to 1.2) and the degree of electrochemical decomposition of the alkali metal chloride (the degree of conversion of the chloride to hydroxide) of from 0.55 to 1.0. Calculations show that the minimum rate of the solution of sodium chloride supply into the electrolyzer (corresponding to the rate of passage of the anolyte through the diaphragm under the electrolysis conditions without recycling of the anolyte) in the prior art process is 6.5 ml/hr per 1 A of the electrolysis current. The degree of electrochemical decomposition of sodium chloride is 0.55 to 1.0 is equivalent to the production of a solution of an alkali metal hydroxide with a concentration of not less than 200 g/l. The maintenance of the alkali metal hydroxide concentration at a level of 350 to 780 g/l in the prior art process (without recycling and after-saturation of the anolyte) can be effected only by replenishing the catholyte by means of a concentrated solution of sodium hydroxide or a solid alkali, or a partial evaporation of the catholyte, followed by its recycling to the cathodic space of the electrolyzer.

The content of the alkali metal chloride in the anolyte during electrolysis ranges from 2.5 to 4.0 mol/l (150–250 g/l) of sodium chloride.

An average current yield is 93 to 95%.

The prior art process has a disadvantage residing in a high content of the impurity of an alkali metal chlorate in the resulting solution of the alkali metal hydroxide, the necessity of recycling and after-saturation of the latter solution to maintain a high concentration thereof.

The prior art process most resembling that of the present invention in its subject matter and the result obtained is a process for producing a concentrated solution of an alkali metal hydroxide, for example, sodium hydroxide, and chlorine by way of an electrochemical decomposition of an alkali metal chloride, e.g. sodium chloride in an electrolyzer with a filtering diaphragm, while passing a solution through the diaphragm and a degree of decomposition of the chloride of from 0.55 to 1.0 and maintaining the alkali metal chloride concentration in the electrolyzer of from 4.3 to 5.3 mol/l and the anolyte pH value of from 1.5 to 2.5.

The electrolysis is conducted at the temperature of 90° C. During the electrolysis a solution of an alkali metal chloride, e.g. sodium chloride, is recycled through a vessel, where in it is after-saturated with the alkali metal chloride and acidified. To obtain a high-concentration solution of the alkali metal hydroxide directly in the electrolyzer, into the cathodic space during the electrolysis there is introduced a solution of sodium hydroxide with a concentration of from 700 to 750 g/l. The calculations show that the flow rate of the anolyte through the diaphragm is at least 7 ml/hr per 1 A of the electrolysis current.

The average current yield of sodium hydroxide is 96.3%. The content of impurities of sodium chlorate in the obtained sodium hydroxide is 0.22–0.42 g/l, that of sodium chloride—not less than 6–10 g/l. (cf. USSR Inventor's Certificate No. 831869 "Process for producing concentrated solution of alkali metal hydroxide and chlorine", by V. L. Kubasov, L. I. Yurkov, A. F. Mazarko, F. I. Lvovich and M. A. Melnikov-Eichenwald Published May 23, 1981).

This prior art process has a disadvantage residing in a high content of the impurity of sodium chlorate in the resulting solution of an alkali metal hydroxide and complicated character of the process associated with the necessity of admission of sodium hydroxide into the cathodic space of the electrolyzer.

SUMMARY OF THE INVENTION

It is an object of the present invention to provide such process conditions which would make it possible to lower the content of the contaminating sodium chlorate in the resulting concentrated solution of an alkali metal hydroxide without reducing the current yield and to simplify the process.

This object is accomplished by a process, wherein according to the present invention, the production of a concentrated solution of sodium hydroxide and chlorine is effected by electrochemical decomposition of a concentrated solution of sodium chloride with the concentration of the latter of from 4.3 to 5.3 mol/l at a temperature within the range of from 90° to 108° C., with the degree of decomposition of sodium chloride of from 0.9 to 1.0 and at the flow rate of the solution of sodium chloride through the diaphragm of 3–5 ml/hr per 1 A of the electrolysis current and subsequent removal of the electrolysis products from the process.

In order to lower the content of impurities of sodium chlorate in the obtained final product, the electrochemical decomposition according to the present invention is conducted at a temperature within the range of from 95° to 105° C.

The process according to the present invention makes it possible to substantially simplify the currently known production of chlorine by the diaphragm method, since it ensures the formation, directly in the course of electrolysis (in the electrolyzer), of a concentrated solution of sodium hydroxide containing up to 45 to 50% by mass of NaOH, i.e. a commercial product without the stage of evaporation or at minimal expenses for evaporation of the solution of sodium hydroxide.

At the present time the rate of consumption of the heating steam for evaporation of electrolytic liquors produced by the diaphragm method amounts to 2–4 ton (639 kcal/kg) per ton of 100% NaOH.

The process according to the present invention makes it also possible to obtain a concentrated solution of potassium hydroxide.

DETAILED DESCRIPTION OF THE INVENTION

In an electrolyzer with a filtering diaphragm, perforated cathode and a low-wear anode the process of electrochemical decomposition of a concentrated solution of sodium chloride is conducted at a temperature ranging from 90° to 108° C., preferably from 95° to 105° C. Into the anodic space of the electrolyzer there is continuously fed an excessive amount of a concentrated solution of sodium chloride containing 300 to 325 g/l (5.15 to 5.5 mol/l) of NaCl.

To maintain a high concentration of sodium chloride in the anodic space of the electrolyzer (in the anolyte) at the level of 4.3 to 5.3 mol/l of NaCl, at least a portion of the solution of sodium chloride is continuously discharged from the electrolyzer, after-saturated with respect to NaCl and recycled back to electrolysis.

At a concentration of sodium chloride of below 4.3 mol/l the concentration of sodium hydroxide in the cathodic space of the electrolyzer is lowered thus causing additional power consumption for evaporation of the resulting solution of sodium hydroxide.

At a concentration of sodium chloride in the electrolyzer over 5.3 mol/l, there is observed precipitation of the solid phase of sodium chloride in the anodic space of the electrolyzer and clogging of the filtering diaphragm with this solid phase. The rate of flow of the solution of sodium chloride through the diaphragm is 3 to 5 ml/hr per 1 A of the electrolysis current. At a flow rate of the sodium chloride solution through the diaphragm below 3 ml/hr per 1 A of the electrolysis current and at a flow rate of the solution of sodium chloride above 5 ml/hr per 1 A of the electrolysis current, the current yield of sodium hydroxide is reduced simultaneously with increasing concentration of sodium chlorate therein. From the cathodic space of the electrolyzer there is withdrawn a concentrated solution of sodium hydroxide containing up to 45–50% by mass of NaOH. The degree of electrochemical decomposition of sodium chloride during electrolysis is 0.9 to 1.0. The process of electrolysis is conducted at a temperature within the range of from 90° to 108° C. At a temperature of below 90° C. or higher than 108° C. the current yield of sodium hydroxide is lowered.

The flow rate of the solution of sodium chloride through the filtering diaphragm is adjusted by pressure drop in the anodic and cathodic space of the electrolyzer.

For a better understanding of the present invention, some specific examples are given hereinbelow by way of illustration.

EXAMPLES OF THE INVENTION

EXAMPLE 1

In an electrolyzer with a filtering diaphragm deposited onto a perforated steel cathode with a low-wear titanium anode with deposited thereonto oxides of ruthenium and titanium (70 mol.% of $TiO_2$ and 30 mol.% of $RuO_2$) the process of electrochemical decomposition of a concentrated solution of sodium chloride is conducted at the current density of 0.2 A/cm$^2$ and at the temperature of 100° C.

Into the anodic space of the electrolyzer there are continuously fed 700 ml/hr of a solution containing 310 g/l of sodium chloride (5.3 mol/l).

The content of sodium chloride during the process of electrochemical decomposition is 285 g/l (4.9 mol/l) of NaCl, pH of the anolyte is 4.05. The rate of the flow of sodium chloride solution through the diaphragm is 3.4 ml/hr per 1 A of the electrolysis current. From the cathodic space of the electrolyzer there are withdrawn 2.4 ml/hr of a concentrated solution of sodium hydroxide containing 632 g/l of NaOH. The degree of electrochemical decomposition of sodium chloride during electrolysis is 0.9. The current yield of the alkali is 96.5%. The content of sodium chloride and sodium chlorate in the concentrated solution of sodium hydroxide removed from the cathodic space of the electrolyzer is 19 g/l and 0.085 g/l respectively.

Example 2

In the same electrolyzer as described in the foregoing Example 1 the process of electrochemical decomposition of sodium chloride is conducted under the same conditions as in Example 1, with the only difference that the process temperature is 95° C., pH of the anolyte is 3.8, the content of sodium chloride in the anolyte is 280 g/l (4.9 mol/l). The rate of flow of the anolyte through the diaphragm is 5.0 ml/hr per 1 A of the electrolysis current. From the cathodic space of the electrolyzer there are withdrawn 3.2 ml/hr of the concentrated solution of sodium hydroxide containing 462 g/l of NaOH. The degree of electrochemical decomposition of sodium chloride is 0.96. The current yield of the alkali is 96.0%. The content of sodium chloride and sodium chlorate in the concentrated solution of sodium hydroxide withdrawn from the cathodic space of the electrolyzer is 40.8 g/l and 0.078 g/l respectively.

Example 3

In the electrolyzer described in Example 1 hereinbefore the process of electrochemical decomposition of sodium chloride is conducted under the same conditions as in Example 1 with the only difference that the process temperature is 95° C., pH of the anolyte is 4.2, the content of sodium chloride in the solution is 250 g/l. The rate of flow of the solution of sodium chloride through the diaphragm is 5.4 ml/hr per 1 A of the electrolyzer load. From the cathodic space of the electrolyzer there are withdrawn 3.7 ml/hr of a concentrated solution of sodium hydroxide containing 405 g/l of NaOH, 51.3 g/l of sodium chloride and 0.301 g/l of sodium chlorate. The degree of electrochemical decomposition of sodium chloride is 0.91. The current yield of the alkali is 93.5%.

Example 4

In the electrolyzer described in Example 1 hereinbefore the process of electrochemical decomposition of sodium chloride is conducted under the same conditions as in Example 1 with the only exception that the process temperature is maintained equal to 105° C., pH of the anolyte is 4.1, the content of sodium chloride in the solution is 262 g/l. The rate of flow of the solution of sodium chloride through the diaphragm is 5 ml/hr per 1 A of the electrolyzer load. From the cathodic space of the electrolyzer there are withdrawn 2.6 ml/hr of a concentrated solution of sodium hydroxide containing 580 g/l of NaOH, 23.5 g/l of sodium chloride and 0.085 g/l of sodium chlorate. The degree of electrochemical decomposition of sodium chloride is 0.94. The current yield of the alkali is 97%.

Example 5

In the same electrolyzer described in Example 1 the process of electrochemical decomposition of sodium chloride is conducted under the same conditions as in Example 1, except that the process temperature is maintained equal to 105° C., pH of the anolyte is 4.1, the content of sodium chloride in the anolyte is 270 g/l (4.6 mol/l). The rate of flow of the anolyte through the diaphragm is 3.5 ml/hr per 1 A of the electrolysis current. From the cathodic space of the electrolyzer there are withdrawn 2.1 ml/hr of a concentraed solution of sodium hydroxide containing 720 g/l of NaOH, 2.3 g/l of sodium chloride and 0.085 g/l of sodium chlorate. The degree of electrochemical decomposition of sodium chloride is 0.9. The current yield of the alkali is 98%.

Example 6

In the same electrolyzer as described in Example 1 the process of electrochemical decomposition is conducted under the same conditions as in Example 1, except that the process temperature is 100° C., the content of sodium chloride in the anolyte is 285 g/l (4.9 mol/l), pH of the anolyte is 3.5, the rate of flow of the anolyte through the diapragm is 3.5 ml/hr per 1 A of the electrolysis current. From the cathodic space of the electrolyzer there are withdrawn 2.4 ml/hr of a concentrated solution of sodium hydroxide containing 625 g/l of NaOH, 16 g/l of sodium chloride and 0.086 g/l of sodium chlorate. The degree of electrochemical decomposition of sodium chloride is 0.95. The current yield of the alkali is 96.9%.

Example 7

In the same electrolysis as described in Example 1 the process of electrochemical decomposition of sodium chloride is conducted under the same conditions as in Example 1, except that the process temperature is maintained equal to 108° C., pH of the anolyte is 3.7, the content of sodium chloride in the anolyte is 280 g/l (4.8 mol/l). The rate of flow of the anolyte through the diaphragm is 3.0 ml/hr per 1 A of the electrolysis current. From the cathodic space of the electrolyzer there are withdrawn 2.0 ml/hr of a concentrated solution of sodium hydroxide containing 710 g/l of NaOH 14.1 g/l of sodium chloride and 0.12 g/l of sodium chlorate. The degree of electrochemical decomposition of sodium chloride is 0.9. The current yield of sodium hydroxide is 96.2%.

Example 8

In the same electrolyzer as described in Example 1 the process of electrochemical decomposition of sodium chloride is conducted under the same conditions as in Example 1, except that the process temperature is maintained equal to 90° C., pH value of the anolyte is 3.5, the content of sodium chloride in the anolyte is 285 g/L (4.85 mol/l). The degree of flow of the anolyte through the diaphragm is 2.6 ml/hr per 1 A of the electrolysis current. From the cathodic space of the electrolyzer there are withdrawn 1.8 ml/hr of a concentrated solution of sodium hydroxide containing 675 g/l of NaOH, 12.0 g/l of sodium chloride and 0.226 g/l of sodium chloride and 0.226 g/l of sodium chloride. The degree of electrochemical decomposition of sodium chloride is 0.92. The current yield of the alkali is 94.2%.

What is claimed is:

1. A process for producing a concentrated solution of sodium hydroxide and chlorine comprising an electrochemical decomposition at a temperature within the range of from 90° to 108° C. of a concentrated solution of sodium chloride with a concentration of from 4.3 to 5.3 mol/l with a degree of decomposition of sodium chloride of 0.9–1.0 and at a rate of flow of the solution of sodium chloride through a filtering diaphragm of from 3 to 5 ml/hr per 1 A of the electrolysis current and the electrolysis products are withdrawn from the process.

2. A process for producing a concentrated solution of sodium hydroxide and chlorine as claimed in claim 1, wherein the electrochemical decomposition is conducted at a temperature within the range of from 95° to 105° C.

* * * * *